United States Patent [19]

Suzuki

[11] 4,163,152

[45] Jul. 31, 1979

[54] PENCIL-SHAPED RADIATION DETECTION IONIZATION CHAMBER

[75] Inventor: Arata Suzuki, Pittsburgh, Pa.

[73] Assignee: Capintec Inc., Montvale, N.J.

[21] Appl. No.: 836,800

[22] Filed: Sep. 26, 1977

[51] Int. Cl.[2] ..... H01J 39/28

[52] U.S. Cl. ..... 250/374

[58] Field of Search ..... 250/252, 374, 375, 388, 250/445 T

[56] References Cited

U.S. PATENT DOCUMENTS

| | | | |
|---|---|---|---|
| 2,573,999 | 11/1951 | Victoreen | 250/374 |
| 3,867,638 | 2/1975 | Golden | 250/252 |
| 4,014,109 | 3/1977 | Schramm | 250/252 |

*Primary Examiner*—Alfred E. Smith
*Assistant Examiner*—Janice A. Howell
*Attorney, Agent, or Firm*—Fleit & Jacobson

[57] ABSTRACT

A radiation detection ionization chamber comprising an elongated cylindrical pencil-shaped tubing forming an outer wall of the chamber and a center electrode disposed along the major axis of the tubing is disclosed. The length of the chamber is substantially greater than the diameter. A cable connecting portion at one end of the chamber is provided for connecting the chamber to a triaxial cable. An end support portion is connected at the other end of the chamber for supporting and tensioning the center electrode.

17 Claims, 6 Drawing Figures

PENCIL-SHAPED RADIATION DETECTION IONIZATION CHAMBER

BACKGROUND AND SUMMARY OF THE INVENTION

The invention relates to a radiation detection ionization chamber for measuring radiation in a computer assisted tomographic system (hereinafter sometimes referred to as a CT scanner). The invention also relates to a radiation exposure measuring apparatus for specifically measuring the radiation produced in a CT scanner, and a method for measuring the radiation exposure in a CT scanner.

Computer assisted tomographic scanners, or CT scanners, generally comprise an X-ray, or other radiation, source, and a detector positioned at opposite sides of a space in which a part of a human body is positioned. The source and detector are adapted to rotate about the body to scan the body. An x-ray slice can be obtained by such a scan and the information directed to a computer wherein the signals are processed to form a reproduction of the internal portion of the human body being scanned. Such CT scanners can comprise a single radiation source and a single detector, or a plurality of sources and detectors, wherein the later arrangement produces a plurality of X-ray slices with a single scan. A description of CT scanning technique and theory is provided in "Introduction to Computer Tomography" copyrighted 1976, published by General Electric Co.

With the advent of the CT scanner, it has become important to provide for some means to measure the radiation produced in a scanner to determine the exposure levels, or dosage, on the object to be scanned. To this date, there has been no uniform apparatus or method used to measure the X-ray radiation dosage produced by the CT scanner, and it is an object of this invention to provide for an apparatus and method for measuring the exposure levels in a CT scanner.

One current method employed for measuring exposure, or dose, and the dose distributions due to CT scanning, is to use a large number of thermo-luminescent detectors (TLDs) that are placed around a phantom. However, such TLDs have disadvantages over an ionization chamber with regard to precision, accuracy, and ease of reading.

In order to properly measure the exposure of a CT scanner, it is an object of this invention to provide a probe that is able to detect radiation directed from all angles of 360°. It is further an object of this invention to obtain an exposure reading using only a single scan of the CT scanner. Still further, it is an object of the invention to provide a method and apparatus that provides for the dosage intercomparison of different CT scanners.

The detection chamber of the present invention is an elongated pencil shaped chamber comprising an elongated cylindrical plastic tubing having a length along a major axis of the tubing substantially greater than the diameter of the tubing. Positioned centrally along the major axis of the tubing is an elongated center electrode, formed of air equivalent plastic. At one of the ends of the tubing is a cable connector structure which is designed to connect the center electrode to a conductor of an electrical cable and to connect the tubing to another conductor of the electrical cable. At the opposite end of the chamber is a support structure for supporting the center electrode within the tubing and to provide tensioning of the center electrode between the cable connector and the support structure.

It is further an object of this invention to provide a new and unique radiation detection chamber for use in a CT scanner. Moreover, it is an object of this invention to provide the radiation detection chamber in a pencil-sized shape that is compact, inexpensive and easy to assemble and calibrate.

It is still further an object of this invention to provide a detection chamber having a center electrode of air equivalent plastic to be positioned in a tensioned state and capable of being exposed to radiation in a full 360° circle.

It is yet another object of this invention to provide a new and unique structure for clamping and tensioning the center electrode of a detection chamber and for connecting the center electrode to an electrical cable, such as a triaxial cable, in order that the device can be simply and quickly positioned within the CT scanner and interconnected, by means of the electrical cable, to suitable and conventional signal processing circuits to detect the current induced in the center electrode as a result of the radiation impinging upon the chamber.

Another embodiment of the invention relates to an apparatus for measuring the radiation produced in a CT scanner. The apparatus comprises a phantom block designed to approximate the size of the human body portion that is to be scanned in order to determine the radiation impinging on the human body portion, and to provide suitable means for attaching the detection chamber to the phantom. The phantom comprises a block of preferably polystyrene material that is shaped so as to be positioned within the patient positioning space of the CT scanner. The phantom can be a single unitary block or can be composed of a plurality of block portions fixedly secured to each other to form a unitary structure. The chamber can be attached to the block at the exterior around the periphery of the block, or the block can be provided with holes in which the elongated pencil chamber is positioned.

The invention also relates to a method for measuring radiation in a CT scanner by using the apparatus discussed above. By attaching an elongated pencil detection chamber to a phantom block approximating the size of the object to be scanned, and scanning the phantom and chamber, one can obtain readings to measure the radiation dose of the scanner.

The pencil-type chamber has applications other than for a CT scanner. The chamber can be used as a linear scale (ruler) for field size measurements to determine 50% exposure boundaries in a diagnostic or thereapeutic system. This is a very useful tool for a field service man who has to align the light field indicator to the X-ray field.

DETAILED DESCRIPTION OF THE DRAWINGS

Figure 1:
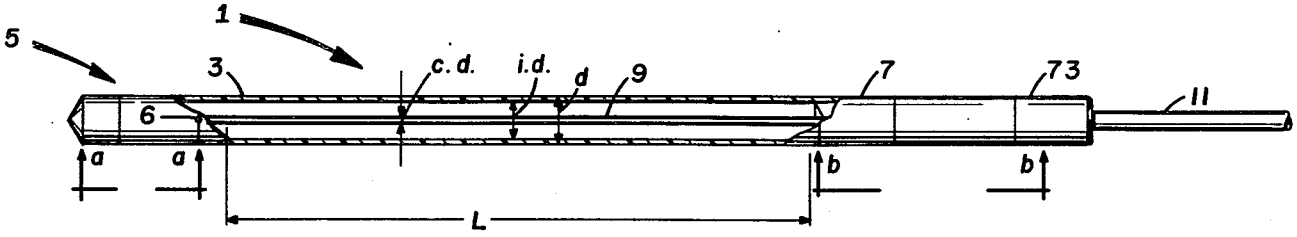
FIG. 1 is an overall view of the radiation detection pencil-type chamber.
Figure 2:
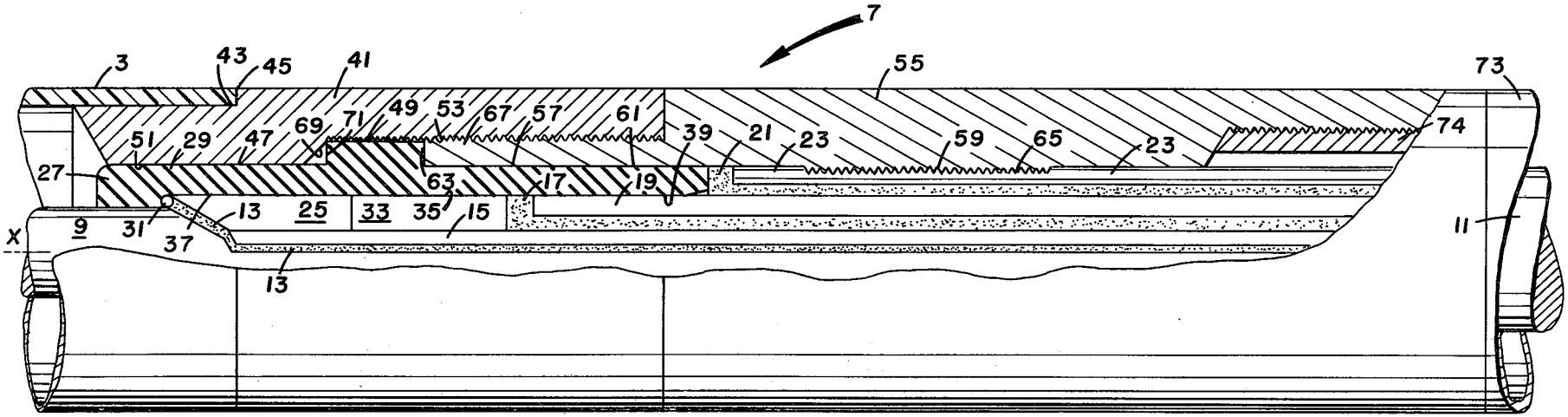
FIG. 2 is a partial cross-sectional view of the cable connection portion of the chamber, as indicated by section b in FIG. 1.
Figure 3:
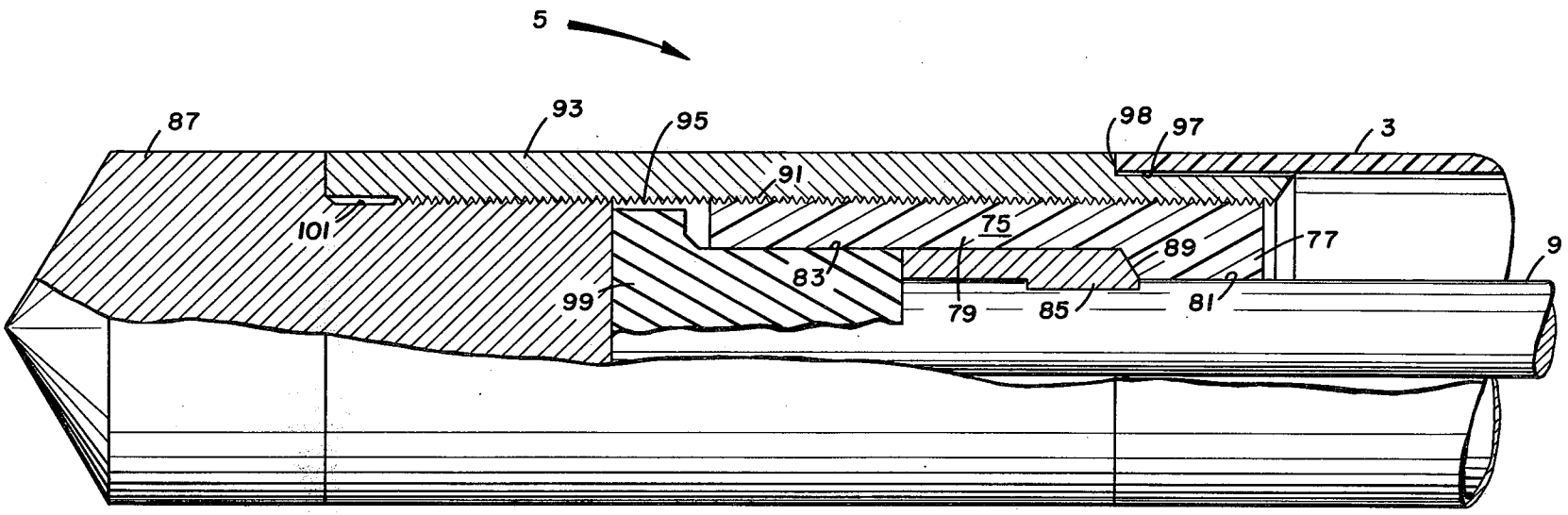
FIG. 3 is a partial cross-sectional view showing the end support structure, as indicated by section a shown in FIG. 1.

Referring to FIGS. 1-3, the radiation detection chamber 1 is a cylindrical, elongated pencil-shaped body having a tubing 3 that defines the outer walls of the chamber. The tubing is interconnected between an end support structure 5 and a cable clamping structure 7. The length L of the chamber 1 is substantially greater than the diameter d of the chamber. Generally, the required length of the chamber is determined by the radiation field distributions and by ease of handling and manufacturing requirements. It is necessary that the length of the chamber be such that the chamber covers the entire length of the radiation distribution (perpendicular to the tomographic scanning plane) arising from the incident beam and the scattered radiation. The small diameter of the chamber is desired in order to measure the exposure at an approximate point within the body positioning region of the CT scanner. With an outer diameter d of the chamber being 7 millimeters, it has been found that the length of the chamber L can be 5, 10, or 15 centimeters, although other sizes may be employed that satisfy the above requirement. Thus, it is preferred that the chamber length L be approximately 7 to 21 times the diameter d of the chamber. A diameter of 10 millimeters is also acceptable. By increasing the diameter, the insulation path becomes longer, hence improving the insulation of the center electrode with respect to the outer tubing, and thus increasing reliability. Since the sensitivity of the chamber is increased as the square of the diameter, measurement accuracy at low level exposures is improved as the diameter increases.

The outer chamber wall is a tubing 3 formed of conducting plastics preferably air equivalent plastic. The tubing 3 is of a small thickness, approximately 0.3 millimeters. Positioned centrally along the major axis of the tubing is a center electrode 9, also preferably made of air equivalent plastic. A preferred embodiment of the chamber provides for the center electrode 9 having a diameter c.d of 1.9 millimeters.

Air equivalent plastic is defined as plastic having a response to photons (x-rays, $\gamma$-rays) per unit mass of material equivalent to that of air. An air equivalent plastic found useful is Type C-552 Air Equivalent Plastic supplied by Physical Sciences Laboratory, and is composed of 78.4% Polyvinylidene fluoride (KYNAR), 20.75% Carbon (VULCAN X-C72), and 0.85% Silica (CABOSIL).

Both the center electrode 9 and the tubing 3 are connected at the cable connection portion 7 to conductors of an electrical triax cable 11. The end support 5 of the chamber 1 is designed to support the center electrode 9 centrally within the chamber and to assure that the center electrode 9 is tensioned within the chamber with respect to the outside tubing wall 3. The center electrode 9 is in tension whereas the tubing wall 3 is in compression. The center electrode 9 is kept under tension in order to reduce microphonic noise (noise produced by vibration of the chamber).

Referring to FIG. 2, the cable connection portion is shown attached to a triaxial cable 11 for purposes of illustration. The triaxial cable 11, per se, forms no part of this invention, but is illustrated to show the new and unique interconnection of the chamber 1 thereto. The triaxial cable 11 comprises a inner conductor 13, surrounded by a inner dielectric 15. Surrounding the inner dielectric 15 is an inner conducting shield 17 which in turn is surrounded by an outer dielectric 19. Surrounding the outer dielectric 19 is an outer conducting shield 21 which is in turn surrounded by the triaxial cable jacket 23. The chamber 1 is interconnected and secured to the cable 11 in a manner to be described. One type of triaxial cable found successful is manufactured in accordance with applicant's specifications by Microdot Co., of South Pasadena, Calif. Such a cable has a cable jacket made of extruded TEFZEL (ethylene fluorocarbon copolymer manufactured by DuPont), which is a rather hard and strong plastic. Both the outer conducting shield 21 and the inner conducting shield 17 are made of braided fine copper wires. The inner conducting shield 17 can also include two layers of carbon coated TEFLON tapes that are conductive.

The center electrode 9 at an end thereof, comprises a cylindrical ridge portion 25. The annular cylindrical ridge portion 25 supports the inner conductor 13 of the triaxial cable 11 in the manner shown in FIG. 2 of the drawings. The inner conductor 13 of the triaxial cable 11 is wrapped around the throat or ridge portion 25 of the center electrode 9 to provide electrical contact therewith. The ridge portion 25 is shown exaggerated in the drawings and in practice need only be of a slightly larger diameter than the diameter of the center electrode. In practice, it has been found that the radius from the major axis x of the chamber of the ridge portion 25 of the center electrode 9 be only about 20 mils greater than the radius of the center electrode.

An insulator sleeve 27 is provided to surround the center electrode 9, and inner conductor 13 wrapped therearound, in a manner to assist in clamping the inner conductor 13 to the center electrode 9. The insulator sleeve 27 is annular and cylindrical in shape and has a nose portion 29 defining a ridge 31 corresponding to the ridge 25 on the center electrode 9, and is designed to secure the inner conductor 13 between the ridge 25 of the center electrode 9 and the insulator sleeve 27. The insulator sleeve 27 is made of an insulating material, preferably machined from a REXLITE (Pennwalt Co. trademark) rod. REXLITE is a type of polystyrene.

Disposed rearwardly of the center electrode 9 and concentrically mounted around the inner dielectric 15 of the triaxial cable 11 is an insulating bead 33. The insulating bead 33 is annular and has an outside diameter corresponding to the rear end diameter of the center electrode 9, so that the outer cylindrical surface 35 of the insulating bead 33 is flush with the outside cylindrical surface 37 of the center electrode ridge portion 25. The insulating bead 33 makes contact at surface 35 with, and is supported on the triaxial cable 11 by, the insulator sleeve 27. The purpose of the insulating bead 33 is to ensure against electrical contact between the center electrode 9 and the inner conducting shield 17 of the triaxial cable 11 and to insure contact between the inner conducting shield 17 on the inner surface of the insulator sleeve 27.

The inner conducting shield 17 of the triaxial cable 11 is in electrical contact with the insulator sleeve 27. The purpose of such electrical contact is to by-pass any inner surface leakage current that may occur on the insulator sleeve 27. The inner shield 17 can be connected with the insulator sleeve by first cutting the shield to its predetermined proper length so that when the copper braid of the conducting shield is opened slightly, it will fill the space between the bead 33 and the outer dielectric 19, and then contact the inner surface of the insulator sleeve 27. The outer dielectric 19 that surrounds the inner shield 17 is also in contact with the rear end portion of the insulator sleeve 27 at surface 39.

Concentrically mounted to the insulator sleeve 27 is an insulator sleeve clamp 41. The insulator sleeve clamp 41 is made of conducting material and is welded to the outer tubing 3. The outer tubing 3 fits within a notch 43 of the insulator clamp 41 and is welded thereto at 45. The insulator sleeve clamp 41 is a cylindrical annular clamp wherein the inner cylindrical surface of the annulus is stepped to form two concentric surfaces 47 and 49. The forward most surface 47 is adapted to matingly engage the insulator sleeve 27. The top surface 51 of the insulator sleeve 27 is notched to receive the forward most surface 47 of the insulator sleeve clamp 41. The rearward surface 49 of the insulator sleeve clamp 41 is partially threaded at 53 to engage a cable clamp 55.

The cable clamp 55 comprises an annular cylindrical electrically conducting clamp. The inner surface of the cable clamp 55 comprises two portions 57 and 59. The forward portion 57 is adapted to engage the top rearward portion of the insulator sleeve 27 at concentric surface 61 for contact therewith. The rearward portion 59 of the cable clamp inner surface has a jacket clamping thread 65 over a part of the cable clamp inner surface for clamping the triaxial cable jacket 23 to insure a tight and secure fit therewith. Also engaging the rearward bottom surface 59 of the cable clamp is the outer shield 21 of the triaxial cable 11. Since the cable clamp 55 and the insulator sleeve clamp 41 are electrically conducting, the tubing 3 is in electrical communication with the outer conducting shield 21.

The outer surface of the cable clamp 55, has a notched cylindrical surface 67 at the cable clamp forward end that is threaded and adapted to threadingly engage with the insulator sleeve clamp 41 at 53. It is thus seen that when the insulator sleeve clamp 41 and the cable clamp 55 are threaded with respect to each other, a ridge 69 of the insulator sleeve clamp engages an annular ridge 71 on the insulator sleeve 27 which compresses or moves the insulator sleeve 27 in a rearward direction to thus secure the inner conductor 13 of the triaxial cable 11 firmly to the center electrode 9. When the insulator sleeve clamp 41 is tightened on the cable clamp 55, all of the conductors and all of the insulators at the cable connection are compressed firmly.

Mounted on the rear end of the cable connector 7 is a handle 73 adapted to be grasped for placement into the desired position. The handle 73 has a forwardly extending threaded portion 74 for engaging the cable clamp 55.

Turning now to the end support structure 5 at the opposite end of the chamber, as depicted in FIG. 3, an insulating screw 75, of insulating material such as the polystyrene, REXLITE, is disposed over the opposite end portion of the center electrode 9. The insulating screw 75 is of an annular cylindrical shape, having a forward end portion 77 and a rearward end portion 79. The forward end portion 77 has an inner cylindrical surface 81 at a radius equal to the radius of the center electrode and is adapted to engage the center electrode 9. The rearward portion 79 has an inner surface 83, at a radius greater than the radius of the center electrode 9 and is designed to accommodate a split ring 85. By placing the insulating screw 75 on the center electrode 9, and then placing the split ring 85 therebetween, the pulling of the insulating screw 75 outwards toward the end cap 87, serves to position the split ring 85 in a slanted recess 89 of the insulating screw 75.

The outer cylindrical surface of the insulating screw 75 is threaded 91 so as to engage a tensioning nut 93. The tensioning nut 93 has an inner threaded surface 95 to threadingly engage the insulating screw 75. The outer surface of the tensioning nut has a concentric cylindrical notch portion 97 at the end adjacent the tubing 3 to accommodate the tubing 3. The tubing 3 is welded to the tensioning nut 93. By rotating the tensioning nut 93 with respect to the insulating screw 75 prior to the welding, the insulating screw 75 moves rearwardly toward the end cap direction and stretches the center electrode 9 to a taut condition by means of the split ring 85. At the same time, the ridge 98 on the outer surface of the tensioning nut 93 serves to compress the tubing 3. The tubing 3 is compressed by the tensioning nut 93 and the insulator sleeve clamp 41 therebetween.

An insulating cap 99, preferably made of TEFLON, is provided to seal the end of the center electrode 9 and the split ring 85 and also to seal the end of the insulating screw 75. An end cap 87 is also provided having a threaded outer surface notch portion 101 to be threadedly engaged by the tensioning nut 93. The end cap 87 is screwed into position after the device is assembled. The tubing 3, tensioning nut 93, and end cap 87 are welded together after assembly and testing. Prior to welding, the electrical continuity of each conductor is tested, as well as the insulation of the electrodes with respect to each other, and other mechanical defects. As shown in FIG. 1, a vent 6 can be provided. In a sealed ionization chamber, the chamber gas (in this case air) can have its composition altered due to adsorption by the chamber wall, oxidation of the chamber wall or electrode material, disassociation of the wall, out gas of the wall and insulator, etc. In order to prevent this change, the chamber is ventilated to the environment via a small canal.

Figure 4:
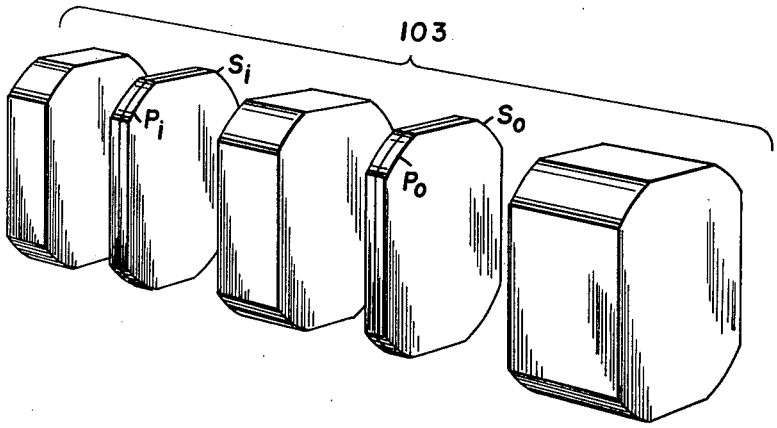
FIG. 4 is an exploded view of the phantom.

Another embodiment of the invention comprises a radiation exposure measuring apparatus for a CT scanner including the radiation detection pencil-shaped chamber 1, discussed above, and a phantom 103, shown in exploded view in FIG. 4. The phantom 103 is preferably a polystyrene plastic block of material. Preferably the phantom is made of material that can closely simulate water in its response to X-rays generated by CT systems. The polystyrene block is a unitary assembly although in FIG. 4, it is shown exploded to depict the imaginary tomographic slices So and Si. The phantom 103 is preferably a unitary assembly and does not comprise separate elements, as shown. Slices So and Si are tomographic slices shown to explain the meanings of the measurements discussed below. The phantom 103 can be a one-piece molded block. The phantom 103 is of a size that approximates the size of the human body portion that is to be measured in the particular CT scanner and should cover the entire chamber of the CT scanner. A number of variously sized phantoms can be employed, and the operator merely selects the phantom that is most approximate in size to the human body portion that is to be scanned. Generally, the phantom is roughly the size of a human head.

Figure 5:
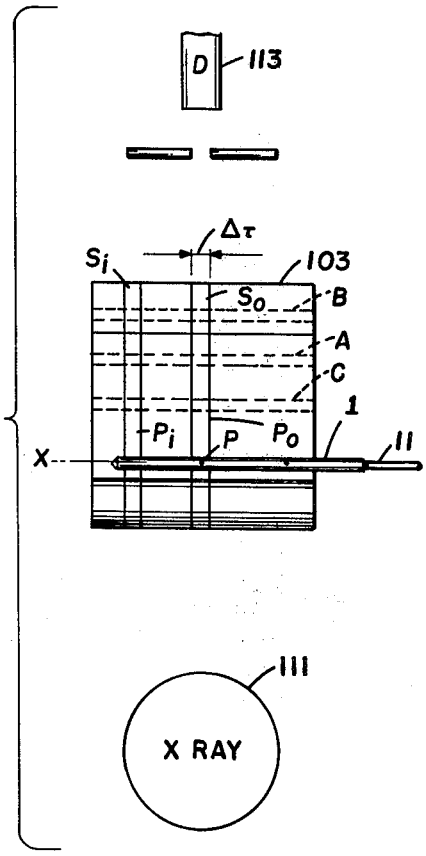
FIG. 5 is a schematic rendering of the positioning of the phantom and chamber within a CT scanner.
Figure 6:
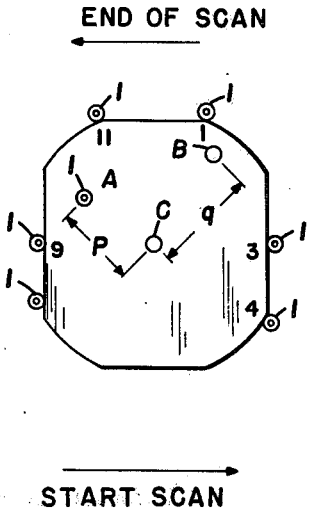
FIG. 6 is a side view of the phantom as shown in FIG. 5.

As shown in FIG. 5, the CT scanner comprises an X-ray source 111 and a detector 113 positioned in spaced-apart arrangement on either side of a space to be occupied by a human body portion. The phantom 103 is positioned between the X-ray source 111 and the detector 113 and the detection chamber 1 is attached to the phantom in such a manner that the major axis x of the chamber 1 is perpendicular to the scanning plane indicated by slices So and Si. The phantom is of a suitable length to accommodate the full length of the detection chamber 1. As shown in FIGS. 4–6, the cross-sectional shape of the phantom is octagonal, although other shapes can be employed, as discussed above.

The pencil-shaped detection chamber 1 is affixed to the phantom 103 at various positions depending upon the point of the human body portion to be sensed by the chamber 1. The chamber 1 can be positioned on the exterior surface of the phantom 103, as shown schematically in FIG. 6, and secured thereto by conventional and suitable securing means such as clamps or tape. Further, the phantom 103 can be provided with holes A, B, C extending in the direction as shown in FIGS. 5 and 6, so as to accommodate the pencil-shaped detection chamber 1. The positioning of the chamber 1 depends upon where the radiation is to be detected.

In operation, the phantom 103 and the pencil-shaped detection chamber 1 are positioned within the space to be occupied by a human body portion within the scanner. As shown in FIGS. 5 and 6, the X-ray source 111 and detector 113 of the CT scanner are rotated to take an X-ray slice, such as So, of the phantom 103 and chamber 1. The detection chamber 1, in a manner well known in the art, converts the radiation impinging thereon to electrical current to be measured with suitable instrumentation. One such instrument suitable for measuring current is the Capintec Model 192 Exposure Meter. The meter provides a direct reading in Roetgens.

It can be demonstrated that when using the above arrangement, in which the midpoint P of the chamber 1 is placed at the point at which the exposure is to be determined, as shown in FIG. 5, and then measuring for a period of one tomographic scan, the exposure (dose) is detected at the point of the chamber P due to the scanning of all the slices. As shown in FIG. 5, it is seen that the chamber 1 measures the exposure, or dose, due to the direct beam intersecting the point P, and to scattering of the beam at other points along the pencil chamber, such as points Pi. However, since the direct beam intersects the midpoint of the chamber, symmetry dictates that the scattered beam measured by the chamber at Pi is equivalent to a beam which scans slice Si and has been scattered into the point Po. Thus, the chamber is measuring the exposure at Po due to all of the scans that cover the entire length represented by the chamber.

Using the above described pencil shaped chamber with a conventional electrometer, when a measurement is made for the period of one tomographic scan, the resulting meter reading is proportional to the exposure (dose) at the point Po due to the scanning for the series of tomographic slices, provided that the entire length of the chamber is sliced with the thickness resolution specified by the CT system. This is approximately equivalent to taking a measurement at point Po with a small volume chamber while the series of scans is being performed.

Exposure due to CT scanning can be characterized in three ways:

1. Compare Roentgen.cm value per slice measured with a phantom for the duration of one tomographic scan;
2. Compare Roentgen.cm value per slice thickness (resolution) measured with a phantom for the duration of one tomographic scan; or
3. Compare Roentgen.cm value per table increment (increment of the table in the axial direction from one tomographic scanning to next scanning) measured with a phantom for the duration of one tomographic scanning. The patient is positioned on the table and the table moves axially at various constant increments, in the typical CT system.

The numerical value of the first characterization as the approximate meaning of the averaged exposure at the axis of the chamber if a uniform subject (uniform in the direction perpendicular to the plane of the scan) is sliced with a constant interval of 1 cm. The second characterization refers to the exposure at the axis of the chamber if a uniform subject is sliced with the thickness resolution, i.e., beam slice thickness specified by the CT system. The third characterization refers to the approximate exposure at the axis of the chamber if the tomographic scannings are performed with a constant table increment.

The exposure meter is set to give a direct reading in Roentgen.cm, and the measurement is made for the duration of one tomographic scan. If one obtains N slices per tomographic scan, the Length-Exposure-Product, (the characteristic exposure value of the CT system) can be calculated by dividing the meter reading M, by N, i.e., $$\text{Length-Exposure-Product per Slice } [R.\text{cm}] = \frac{\text{Meter Reading } [R.\text{cm}] \text{ per one Tomographic Scan}}{\text{Number of Slices per one Tomographic Scan}} = \frac{M\,[R.\text{cm}]}{N}$$

$$\text{The Characteristic Exposure of a CT System, i.e., when sliced with 1 cm. thickness } [R], = \frac{M\,[R.\text{cm}]}{N \cdot 1\,[\text{cm}]}$$

The second characterization can be obtained by further dividing the Length-Exposure-Product per slice by the slice thickness $\Delta t$ (thickness resolution) to obtain the exposure at the axis of the chamber which would be received when the entire length of the phantom is sliced with the thickness resolution specified by the CT system. Thus, $$= \frac{M\,[R.\text{cm}]}{N \cdot \Delta t\,[\text{cm}]}$$

Referring to the third characterization, if the meter reading in Roentgen.cm is divided by the table increment, $\Delta L$ in cm, one can obtain the average exposure to the patient. Thus, $$\text{Patient Exposure, Estimated, } [R] = \frac{\text{Meter Reading } [R.\text{cm}] \text{ per one Tomographic Scan}}{\text{Table Increment } [\text{cm}]} = \frac{M\,[R.\text{cm}]}{\Delta L\,[\text{cm}]}$$

Since, in most cases, the point of the highest exposure is predictable from the scanning program, an exposure measurement for only one scanning period is required to determine the characteristic value of the CT's exposure. A theoretical discussion of the exposure measurement can be found infra.

In order to calibrate the chamber 1, the chamber 1 is exposed to a wide X-ray beam which covers the entire length of the chamber when the chamber is positioned perpendicular to the beam. The charge generated in the chamber (in Nanocoulombs) is measured and the exposure in Roentgens is obtained by using a known chamber that is calibrated, such as at the National Bureau of Standards. Thus, the sensitivity of the chamber in Nanocoulombs/Roentgen is obtained. Dividing by the length of the chamber, one obtains the sensitivity in Nanocoulombs per Roentgen-centimeter.

An example of the invention will now be described:

EXAMPLE

The following data was obtained using a 2-inch (5 cm.) and 4-inch (10 cm.) long detection chamber connected to a Capintec Model 192 Exposure Meter. The pencil detection chamber location is shown in FIG. 6. The tests were performed using a scanner which rotates 180° to accomplish one tomographic scan and obtains two tomographic slices (pictures) per scan. The resolution, i.e., thickness of the slice was 0.75 centimeters. The scan was over 180° as indicated in FIG. 6 of the drawings. The various readings in Roentgen and Roentgen.cm for 2-inch and 4-inch chambers were obtained at the various positions.

| Chamber Location | Reading* N [R.cm] | | Reading* N t [R] | |
|---|---|---|---|---|
| | 2" | 4" | 2"/4" | 4" |
| C center | 0.45 | 0.60 | 0.75 | 0.80 |
| A (ρ = 2½") | 0.44 | 0.56 | 0.79 | 0.75 |
| B (g = 3") | 0.85 | 0.98 | 0.86 | 1.31 |
| 9 | 0.22 | 0.27 | 0.85 | 0.35 |
| 4 | 0.98 | 1.10 | 0.89 | 1.47 |
| 3 | 1.18 | 1.29 | 0.92 | 1.71 |
| 1 | — | 0.95 | — | 1.26 |
| 11 | 0.61 | 0.63 | 0.96 | 0.84 |

*Readng for one scan; 120 kVp (X-ray tube voltage); 20 MA (tube current); HVL (half value) 4mmA; N(number of slices per scan) = 2, Δt (Resolution) = 0.75 cm. 180 ccw 1° step scan starting from lower left.
Capintec 192, 2" chamber sensitivity 0.0954 nC $R^{-1}$ $cm^{-1}$
Capintec 192, 4" chamber sensitivity 0.0913 nC $R^{-1}$ $cm^{-1}$ As is shown in the example, the effect of the extra length of the chamber (from 2 to 4 inches) increased the meter reading from 10 to 30% depending upon the probe location. The radiation distribution becomes wider as radiation passes through media due to scattering of the radiation by the media. A 4 inch, or 10 cm., chamber may not be long enough if one has to determine the dose at a deep location in a large phantom. Since the maximum dose occurs at or near to the surface, a 10 cm chamber will be adequate for most applications The pencil-type chamber can also be used as a linear scale (ruler) for field size measurements to determine 50% exposure boundaries in a diagnostic or in a therapeutic system. This is a very useful tool for a field service man who has to align the light field indicator to the X-ray field. The following steps are employed:

Step (1) Place the entire length of the chamber in the radiation field, take exposure reading for a specific combination of selected parameters of operation. (Reading A)

Step (2) Place the center of a pencil chamber right at an edge of the light field with the chamber axis perpendicular to the boundary of the light field. Take exposure reading with the selected parameters. (Reading B)

If the reading B (Step 2) is just 50% of the reading A (Step 1), the light field boundary and the radiation field boundary are matched. If B is more than 50% of A, the radiation field is extended beyond the boundary of the light field, or vice versa. The misalignment of the light field with respect to the radiation field, Δl, is given as $$\Delta l = \left(\frac{B}{A} - 0.5\right) L$$

where L is the sensitive length of the pencil chamber. A positive misalignment indicates the radiation field is extended beyond the boundary of the light field.

THEORETICAL FORMULATION OF PENCIL CHAMBER RESPONSE

Cylindrical co-ordinates are used in the following discussion. The z axis is defined as the axis about which the source and detector of the CT system revolve, forming the plane of the scan. Thus, the z axis is perpendicular to the plane of the scan.

The distribution of radiation (exposure or dose) at the point $(r,\phi,z)$ generated during one scanning can be given by $$f(r,\phi,z) \tag{1}$$

Let $z_i$ be the position of the i-th scan (i.e., the plane of the scan intersects the point $z_i$).

Then the distribution from the i-th scanning is given by $$f(r,\phi z-z_i) \tag{2}$$

The radiation at the point $(r_m,\phi_m,z)$ due to the i-th scanning is given by $$f(r_m,\phi_m,z-z_i) \tag{3}$$

The exposure integral along a line parallel to the z axis and through the point $(r_m,\phi_m,z)$ (i.e., Exposure-Length product) from the i-th scanning, is given by $$I_m = \int f(r_m,\phi_m,z-z_i)dz \tag{4}$$

The limits of integration are, theoretically, $-\infty$ to $+\infty$, but for practicality can be taken to be $z_i \pm \Delta z_i$, where $\Delta z_i$ is a cut-off beyond which the distribution can be considered to be negligible.

Let L be an arbitrary, very large (i.e., $L >> \Delta z_i$) length parallel to the z axis.

The distance between two successive scannings is given by $$\Delta S_i = |z_i - z_{i+1}| \tag{5}$$

We can therefore, define the number of scans, K, in the lengths L by $$L = \sum_{i=1}^{K} \Delta Si \tag{6}$$

If the distance between scans is constant (i.e., $\Delta s_i = \Delta s$ for all i) then $$L = K \cdot \Delta s \tag{7}$$

where Δs is the table increment.

The total radiation at a point $(r_m, \phi_m, z)$ arising from all K scans is given by, $$I_{m,tot} = \sum_{i=1}^{K} \int_{-\infty}^{+\infty} f(r_m, \phi_m, z - z_i)dz. \quad (8)$$

If the subject being scanned is uniform in the direction of the z axis, and if the intensity of radiation is the same for all the scans, then the distribution from all of the scans is the same (i.e., the distribution no longer depends on $z_i$, so we can take $z_i=0$).

The total radiation from all of the scans can therefore be written $$I_{m,tot} = K \int_{-\infty}^{+\infty} f(r_m, \phi_m, z)dz. \quad (9)$$

The average exposure over the lengths L, along the points $(r_m, \phi_m, z)$ is defined as $$I_{m,ave} = \frac{I_{m,tot}}{L} \quad (10)$$

Using the Equation 9 for total radiation and length L defined by Equation 7, $$I_{m,ave} = \frac{K \int_{-\infty}^{+\infty} f(r_m, \phi_m, z)dz}{K\,\Delta s}$$

Thus, $$I_{m,ave} = \frac{\int_{-\infty}^{+\infty} f(r_m, \phi_m, z)dz}{\Delta s}$$

But, this is simply the intensity (exposure integral) seen by the chamber during one scanning, divided by the distance between scans (table increment).

Since the radiation distribution, f, used in the above discussion is completely arbitrary, the result will not depend upon the radiation distribution. Thus, no knowledge of the beam distribution will be required to determine the average exposure (or dose).

I claim:

1. A radiation detection ionization chamber comprising an elongated cylindrical tubing forming an outer wall of the chamber and having a length along a major axis of the tubing substantially greater than the diameter of the tubing, an elongated center electrode disposed centrally along the major axis of the tubing, said tubing and said center electrode made of air equivalent plastic, a first electrical cable conductor, a second electrical cable conductor, cable connecting means at one end of said tubing for connecting one end of said center electrode to said first electrical cable conductor and for connecting said tubing to said second electrical cable conductor, end supporting means at the opposite end of said tubing for supporting the tubing and the opposite end of said center electrode within the tubing and comprising means for tensioning said center electrode between said cable connecting means and said supporting means.

2. A detection chamber as claimed in claim 1, wherein said means for tensioning said center electrode comprises a tensioning nut interconnected with said opposite end of said center electrode for stretching said center electrode in a direction opposite to the cable connecting means.

3. A detection chamber as claimed in claim 2, wherein said tensioning nut is interconnected with said tubing to compress said tubing simultaneous with the stretching of said center electrode so that said center electrode is tensioned with respect to said tubing.

4. A detection chamber as claimed in claim 1 wherein said length of said tubing and said center electrode are such that when said chamber is exposed to radiation at its midpoint, all appreciable radiation scattering is covered by said tubing and said center electrode.

5. A detection chamber as claimed in claim 1 wherein the length of said tubing is approximately 7 to 21 times the diameter of said tubing.

6. A detection chamber as claimed in claim 1 wherein said one end of said center electrode comprises an annular ridge, said cable connecting means comprises means for receiving said first electrical cable conductor around said annular ridge, first insulator sleeve means for surrounding said one end of said center electrode for retaining said first electrical cable conductor in contact with said center electrode, first insulator sleeve clamping means for clamping said first insulator sleeve means, said first insulator sleeve clamping means made of conducting material and connected to said tubing, cable clamping means for connecting said first insulator sleeve clamping means to said second electrical cable conductor, for clamping an outer jacket of said electrical cable, and for clamping said first insulator sleeve means to said electrical cable.

7. A detection chamber as claimed in claim 6 wherein said first insulator sleeve clamping means comprises a first surface for engagement with said first insulator sleeve means, and a second threaded surface adjacent said first surface, said cable clamping means comprising an annular cylindrical electrically conducting cable clamp, one end portion of said cable clamp having a first inner cylindrical surface engaging and clamping a portion of said first insulator sleeve means, and a first outer cylindrical surface being threaded for threadingly engaging said second surface of said first insulator sleeve clamping means, the other end portion of said cable clamp having a second outer cylindrical surface of a greater diameter than said first outer cylindrical surface, and a second inner cylindrical surface for engaging said second electrical cable conductor and for engaging and clamping the cable jacket of said electrical cable.

8. A detection chamber as claimed in claim 7 wherein said second inner cylindrical surface includes a jacket clamping thread for engaging and clamping the cable jacket, wherein said cable jacket is compressed when the first outer cylindrical surface of said cable clamp is threadingly engaged with said second surface of said first insulator sleeve clamping means.

9. A detection chamber as claimed in claim 6 further comprising means for connecting said first insulator sleeve means to a third electrical cable conductor for bypassing inner surface leakage current of said first insulator sleeve means.

10. A detection chamber as claimed in claim 9 further comprising a triaxial electric cable having an inner conductor, an inner dielectric surrounding said inner conductor, an inner conducting shield surrounding said inner dielectric, an outer dielectric surrounding said inner conducting shield, an outer conducting shield surrounding said outer dielectric, and a cable jacket surrounding said outer conducting shield, wherein said first electrical cable conductor comprises said inner conductor, said second electrical cable conductor comprises said outer conducting shield, and said third electrical cable conductor comprises said inner conducting shield.

11. A detection chamber as claimed in claim 10 further comprising an annular insulating bead means surrounding said inner dielectric for insulating said center electrode from said inner conducting shield.

12. A detection chamber as claimed in claim 1 wherein said end supporting means comprises a split ring means for surrounding said opposite end of said center electrode for gripping said center electrode, insulating screw means comprising an annular cylindrical sleeve, the outer surface of said annular cylindrical sleeve being threaded, the inner surface of said annular cylindrical sleeve having a first portion for engaging said split ring means and a second portion for engaging said center electrode, a tensioning nut surrounding said outer surface of said annular cylindrical sleeve, and having threads for engaging the threads of said annular cylindrical sleeve, said tensioning nut comprising an annular notch means for engaging said tubing at said opposite end of said tubing whereby adjustment of said tensioning nut in a direction toward said tubing moves said annular cylindrical sleeve in an opposite direction for increasing the tension on said center electrode with respect to the compression on said tubing.

13. A radiation exposure measuring apparatus for measuring the radiation produced in a computer assisted tomographic scanner comprising a phantom means for representing a part of a human body to be scanned comprising a three-dimensional plastic body having a shape suitable to be positioned between the source and detector of said scanner, a radiation detection chamber comprising an elongated cylindrical tubing forming an outer wall of the chamber and having a length along a major axis of the tubing substantially greater than the diameter of the tubing, an elongated center electrode disposed centrally along the major axis of the tubing, said tubing and said center electrode made of air equivalent plastic, a first electrical cable conductor, a second electrical cable conductor, cable connecting means at one end of said tubing for connecting one end of said center electrode to said first electrical cable conductor and for connecting said tubing to said second electrical cable conductor, supporting means at the opposite end of said tubing for supporting the opposite end of said center electrode within the tubing and comprising means for tensioning said center electrode between the cable connecting means and the supporting means, and attachment means for attaching said radiation detection chamber to said plastic body.

14. The apparatus of claim 13 wherein said plastic body is made of polystyrene.

15. The apparatus of claim 13 wherein said plastic body comprises a plurality of plastic elements fixedly secured to each other to form a single unitary body.

16. The apparatus of claim 13 wherein said attachment means comprises means for positioning said radiation detection chamber within the interior of said plastic body.

17. A method for measuring the radiation in a computer assisted tomographic scanner having a radiation source and a detector source that are movable in a plane about a patient positioning space, and a radiation detection chamber comprising an elongated cylindrical tube having a length along a major axis of the tubing substantially greater than the diameter of the tubing, an elongated center electrode disposed centrally along the major axis of the tubing, said tubing and said center electrode made of air equivalent plastic, a first electrical cable conductor, a second electrical cable conductor, cable connecting means at one end of said tubing for connecting one of said electrode to said first electrical cable conductor and for connecting the tubing to said second electrical cable conductor, supporting means at the opposite end of said tubing for supporting the opposite end of said center electrode within the tubing and comprising means for tensioning said electrode between the cable connecting means and the supporting means, wherein the method comprises the steps of:

(a) providing a block of material representing a portion of the human body to be scanned;
(b) attaching said radiation detection chamber to said block of material;
(c) positioning said block and chamber within the patient positioning space of the scanner, such that the major axis of said chamber is perpendicular to a scanning plane;
(d) scanning the block and chamber;
(e) measuring the radiation impinging upon said chamber.

* * * * *